United States Patent [19]

Currier

[11] 4,090,557

[45] May 23, 1978

[54] STEAM HEATING SYSTEM AND CONDENSER THEREFOR

[76] Inventor: Edward Thomas Currier, 20363 Lorain Rd., Apartment A-1, Fairview Park, Ohio 44126

[21] Appl. No.: 698,954

[22] Filed: Jun. 23, 1976

[51] Int. Cl.[2] ..... F28B 9/08; F28B 5/00; F28B 1/02; F28F 9/22

[52] U.S. Cl. ..... 165/110; 165/145; 165/159; 165/163

[58] Field of Search ..... 165/110, 145, 160, 161, 165/159, 163

[56] References Cited

U.S. PATENT DOCUMENTS

| | | | |
|---|---|---|---|
| 1,509,782 | 9/1924 | Samuelson | 165/110 |
| 1,623,617 | 4/1927 | Braun | 165/110 |
| 2,006,681 | 7/1935 | Mahoney | 165/145 |
| 2,502,675 | 4/1950 | Simpelaar | 165/163 |
| 2,723,109 | 11/1955 | Kirkpatrick | 165/110 |
| 2,735,623 | 2/1956 | Baker | 237/68 |
| 2,756,028 | 7/1956 | Byerley | 165/110 |
| 2,919,903 | 1/1960 | Vautrain et al. | 165/110 |
| 2,995,341 | 8/1961 | Danesi | 165/110 |
| 3,390,721 | 7/1968 | Noe | 165/160 |
| 3,805,881 | 4/1974 | Kenrick et al. | 165/145 |

*Primary Examiner*—Charles J. Myhre
*Assistant Examiner*—Sheldon Richter
*Attorney, Agent, or Firm*—Gustalo Nunez

[57] ABSTRACT

A system for supplying steam to equipment which uses the heat of the steam and not the pressure for performing work such as commercial laundry equipment. The system is a closed loop having a steam boiler which supplies steam directly to the equipment. A control valve regulates the amount of steam flowing through the equipment which determines the heat imparted to the equipment. The equipment is free of heat traps or other components which retard the flow of steam therethrough. The used steam flows into an improved condenser having a plurality of compartments which slows down the velocity of the steam to help facilitate the condensing process and to enable harmful air trapped in the condenser to be removed. Pumps remove the air from the condenser and maintain a vacuum within the condenser and steam return line from the equipment to maintain the steam flowing through the equipment at a desired rate. Cooling water circulates through individual coil groups within each condenser compartment for condensing the returning steam. The cooling water is heated by the steam and transferred to a hot water storage tank for use in other operations of the laundry.

4 Claims, 5 Drawing Figures

STEAM HEATING SYSTEM AND CONDENSER THEREFOR

BACKGROUND OF THE INVENTION

1. Field of the Invention

The invention relates to a system for supplying steam to equipment which uses the heat of the steam for performing work and not the steam pressure. More particularly, the invention relates to a closed loop steam system which is maintained under a vacuum for continuously moving the steam through the equipment to extract heat therefrom, and to an improved condensor for effectively condensing the steam and for creating the system vacuum. The condenser also removes harmful air trapped within the condenser and prevents the air from reaching the boiler. The inherent design of the system conserves heat energy by utilizing the heat exchanged during the condensation process.

2. Description of the Prior Art

Various commercial and industrial establishments utilize equipment which requires steam for heating the equipment or parts thereof to perform work, such as dry cleaning presses, irons, etc., rather than using the pressure of the steam to perform the work as in the case of turbines, steam engines and the like. For example, commercial lanudry irons use steam for heating the irons for pressing shirts, coats and other laundry. This equipment has a series of traps to retard the velocity or passage of the steam until it is turned into a condensed state in order to extract the heat from the steam. When enough steam condenses to fill the trap, it opens permitting more steam to pass to the next trap and to discharge the the condensate from the filled trap.

These traps do not always function properly due to corrosion and sediment buildup, and consequently become clogged, decreasing the efficiency of the machine and preventing the equipment from reaching its required operatinr temperature. This reduced equipment temperature requires a longer time for each pressing or ironing operation and consequently less production. These traps reduce the velocity of the steam passing through the equipment and backs up the steam in the inlet line which results in permature condensation and lower steam temperature, and consequently less efficient steam. Likewise, this heat is being lost to the atmosphere resulting in loss of energy and increased fuel and boiler operating costs. These traps could not be removed from such equipment becuase live steam would be discharged directly into the atmosphere or directly into the boiler feed water tank and then to the atmosphere unless first condensed in a condenser. Therefore, before the traps could be removed from such equipment a condenser is required which permits the system to operate efficiently.

Condensers also effect the efficiency of steam heating systems by permitting the buildup of air within the condenser which is subsequently passed into the boiler. Water in its natural state contains five percent air and when the steam is condensed, the air is separated from the water. This air, since it is heavier than steam and lighter than water lies in the boiler at a disengaging surface. The air causes oxidation within the boiler and retards the steaming capabilities of the boiler. Therefore, it is desirable to eliminate this trapped air to increase boiler efficiency and reduce maintenance. Such oxidation is reduced by special treatment of the boiler feed water prior to its entering the boiler in existing boiler systems. This treatment increases the system operating cost considerably. Therefore it is desirable to provide a closed loop system which greatly eliminates the treatment and amount of boiler makeup water, and which provides means for eliminating such harmful air from within the boiler. Various systems have been devised for eliminating this harmful trapped air such as shown in U.S. Pat. No. 2,735,623.

Most condensers are of the "dry" type wherein the condensate and the circulating cooling water do not come in contact with each other and have a single chamber into which the steam flows to be condensed. A series of pipes pass through the chamber between inlet and outlet headers on the ends of the chamber, thereby providing only a single condensing state. It has been formed in some situations that condenser efficiency is increased by providing stages such as shown in U.S. Pat. Nos. 1,605,312 and 2,502,675.

No known steam heating system of which I am aware provides a closed loop system for use with heating equipment which enables the steam to pass directly through the equipment, which steam flow and equipment temperature is controlled by a single regulating valve by use of a multi-stage condenser which maintains a vacuum on the system and removes harmful air trapped within the condenser.

SUMMARY OF THE INVENTION

Objectives of the invention include providing an improved closed loop steam heating system for heating equipment by permitting the steam to flow unimpeded through the equipment for heating the equipment from the heat entrapped in the steam, and in which a single needle valve controls the steam flow rate through the equipment and consequently the amount of heat transferred; providing such a system which uses an improved condenser construction which is formed with a plurality of condensing compartments, each of which has separate cooling coils for successively condensing the steam while decreasing its velocity; providing such a condenser which pumps air trapped within the condenser through a cooling chamber to remove nearly all of the moisture from this vapor, and then separating the air and water in a vapor trap, and returning the water to the condenser prior to exhausting the air to the atmosphere; providing such a system and condenser in which the cooling water, upon being heated upon condensing the steam, is pumped to a hot water storage tank for subsequent use for other purposes; providing an improved condenser which maintains a vacuum within the condenser chamber and system, whereby the steam is drawn from the equipment being heated into the condenser permitting fresh steam to flow into and through the equipment for efficiently heating the same; and providing such a system and condenser therefor which is efficient, relatively inexpensive and which achieves the stated objectives effectively, and which solves problems and satisfies needs existing in the art.

These objectives and advantages may be obtained by the closed steam heating system, the general nature of which may be stated as including: steam heated equipment; a steam boiler operatively connected to the equipment for supplying steam thereto; valve means for controlling the amount of steam being supplied from the boiler to the equipment; condenser means operatively connected to the equipment for receiving steam from the boiler after passing through said equipment and for condensing the steam into condensate, said condenser having a plurality of compartments for condensing the steam into condensate within the compartments; a boiler feed water supply tank operatively connected to the boiler and condenser means for receiving and storing condensate from the condenser and for supplying the same to the boiler; hot water storage tank means operatively connected to the condenser; a supply of cooling water; individual cooling water supply line means passing through each of the compartments of the condenser means for condensing the steam within the compartments and for heating the cooling water flowing through the supply line means; means for transferring the heated cooling water from the condenser into the hot water storage tank means; pump means operatively connected to the condenser means for maintaining the condenser under a vacuum, and for removing air from within the condenser and discharging it into the atmosphere; and the heated equipment being free of constrictions affecting the flow of steam therethrough whereby the steam flows freely through the equipment and is drawn by the condenser vacuum into the condenser, with the amount of steam passing through the equipment determining the equipment temperature.

These objectives and advantages are obtained further by an improved steam condenser construction, the general nature of which may be stated as including: an airtight housing having top, bottom, side and end walls defining a condensing chamber; first and second partition means mounted within and extending between the side walls of the condensing chamber, dividing said chamber into first, second and third vertically extending compartments; opening means formed adjacent the top of the first partition means providing a passage between the first and second compartments; opening means formed adjacent the bottom of the second partition means providing a passage between the second and third compartments; individual coil tube means extending into each of the compartments for condensing steam into condensate in each compartment; steam line means communicating with the third compartment, with said steam and condensate being adapted to flow into the second and first compartment through the opening means; and pump means communicating with the first compartment for maintaining the condenser under a vacuum and for removing condensate from within the condenser.

BRIEF DESCRIPTION OF THE DRAWINGS

The invention will be more fully understood from the following description when considered in connection with the accompanying drawings which illustrate the best mode in which applicant contemplates carrying out the principle of the invention and in which like numbers refer to like parts in the drawings.

DESCRIPTION OF THE PREFERRED EMBODIMENT

Figure 1:
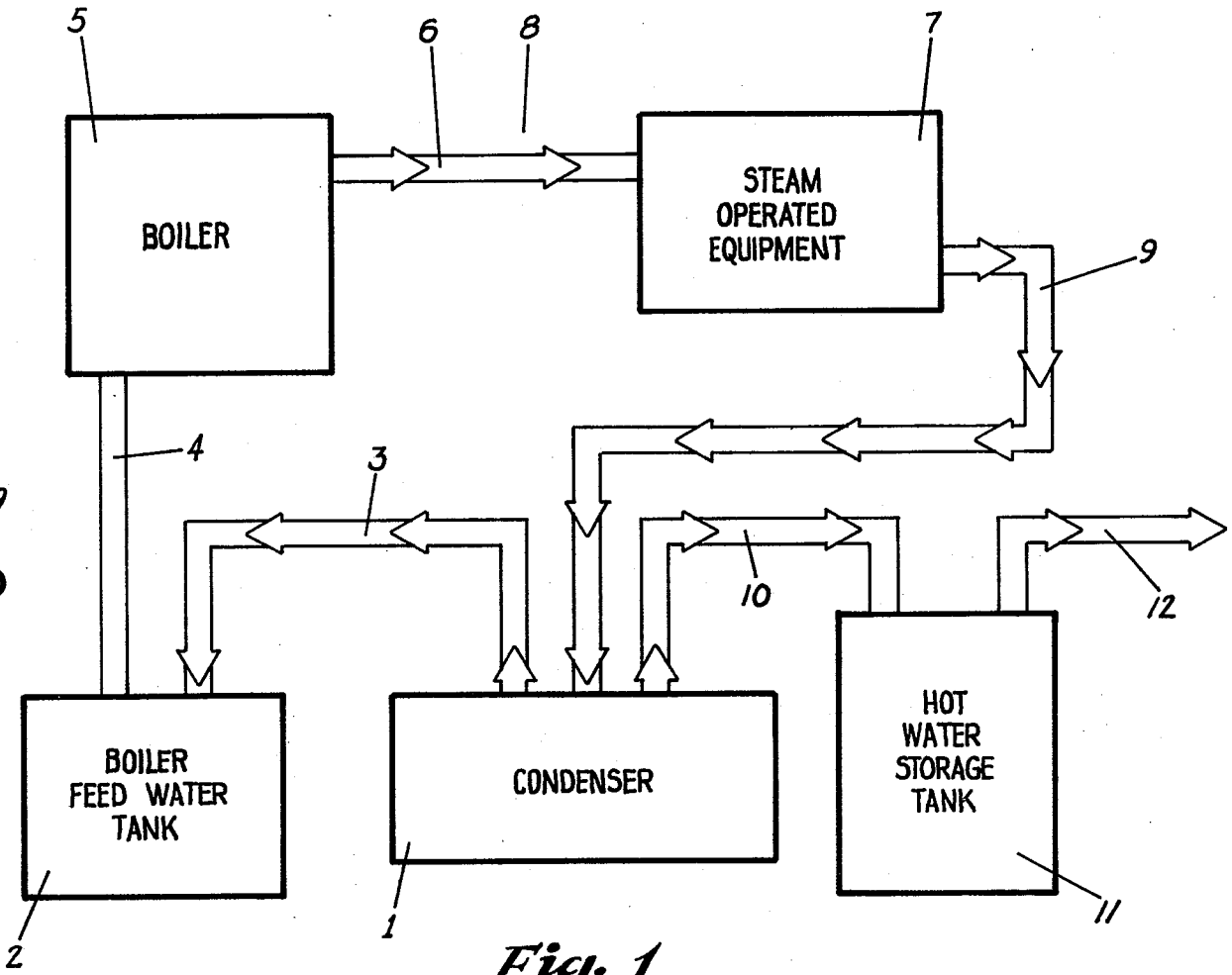
FIG. 1 is a diagrammatic view of the improved steam heating system and condenser construction used therein.

The improved steam heating system is shown diagrammatically in FIG. 1 and includes the improved condenser construction indicated generally at 1. Condenser 1 is connected to a boiler feed water tank 2 by a supply line 3. A water line 4 extends between tank 2 and a steam boiler 5 for supplying water thereto for generation into steam. A steam supply line 6 extends between boiler 5 and the steam heated equipment 7. A control valve 8 is placed in line 6 for regulating the amount of steam flowing into equipment 7.

A steam return line 9 extends between equipment 7 and condenser 1 for returning used steam to the condenser for condensation back into water for boiler 5. A hot water line 10 extends between condenser 1 and a hot water storage tank 11, which includes an outlet hot water line 12, the purposes of which are discussed below.

Figure 2:
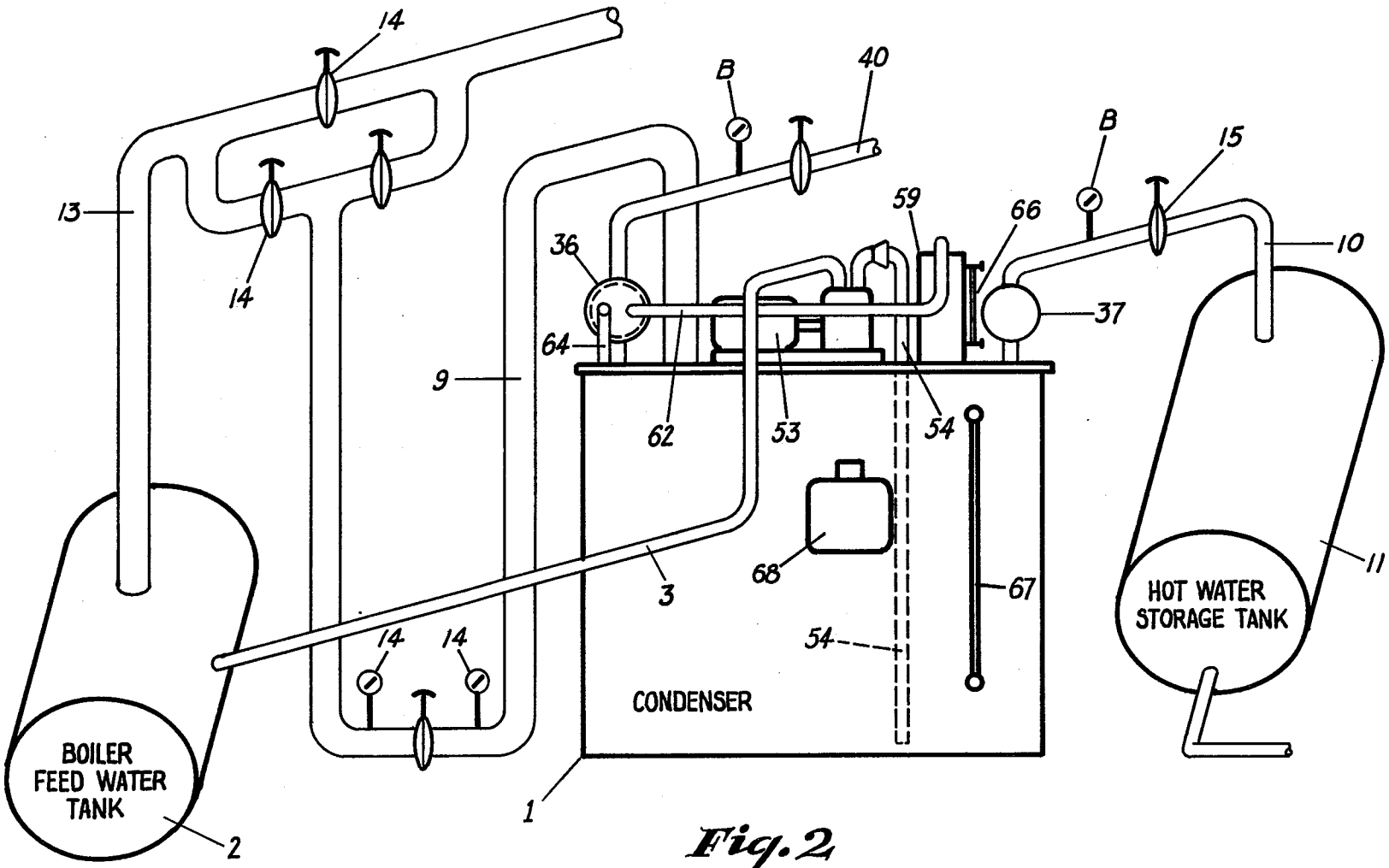
FIG. 2 is a more detailed general diagrammatic view of the main components of the steam heating system shown in FIG. 1, including the improved condenser construction used therein.

The system described above and shown in FIG. 1 shows only the major systems components and not the additional valves, controls and related pipes, gauges, etc. FIG. 2 shows in particular condenser 1, hot water storage tank 11 and boiler feed water tank 2 in greater detail including additional components. For example, steam return line 3 may include a line 13 which connects equipment 7 directly with feed water tank 3 for returning condensate collected in line 9 directly to tank 2 without passing through condenser 1. Lines 9 and 13 may include various pressure gauges and check valves 14 to insure efficient control and regulation of the system. Control valves 15 also may be located in hot water line 10.

Figure 3:
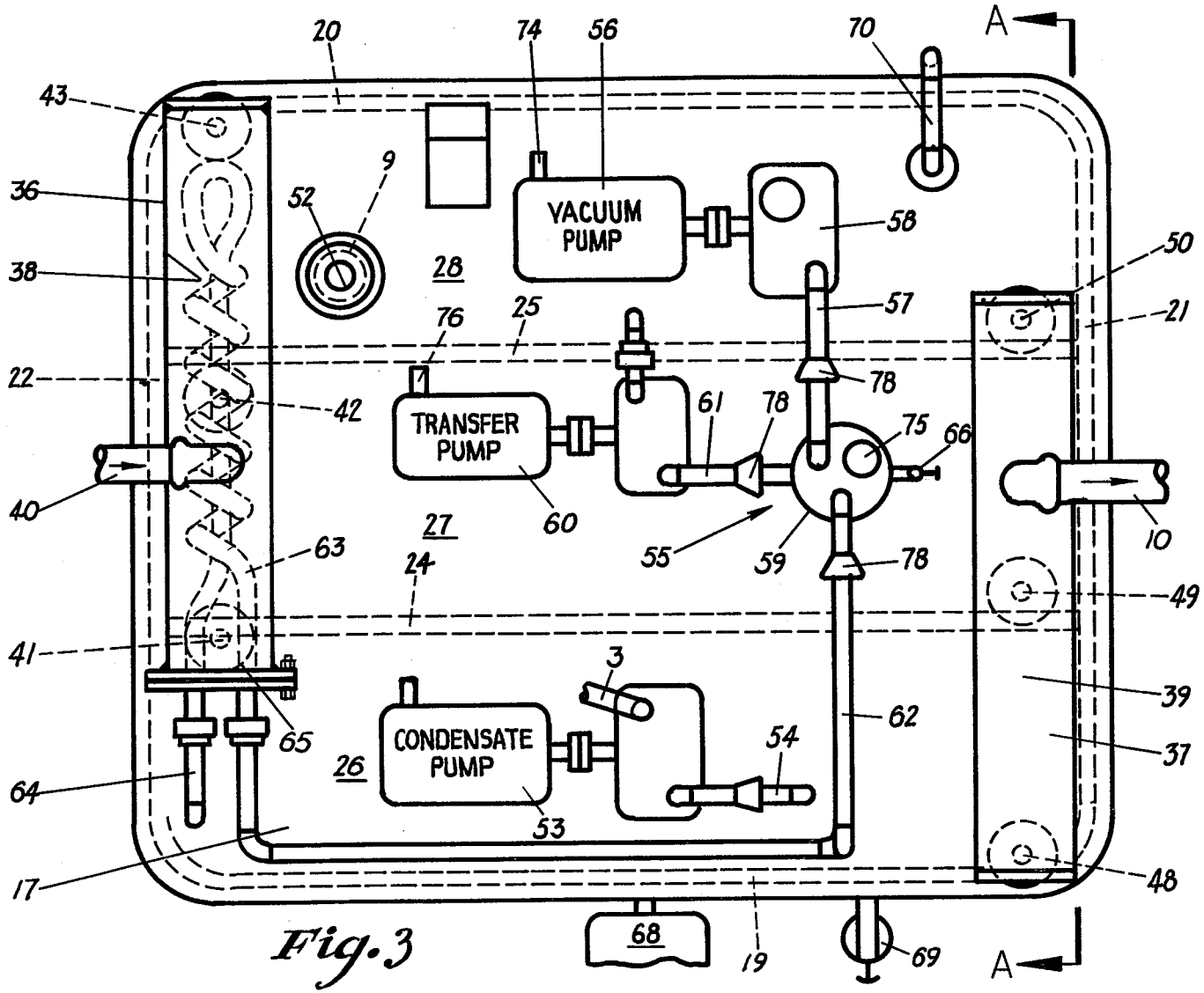
FIG. 3 is an enlarged top plan view of the improved three stage condenser used in the improved steam heating system.
Figure 4:
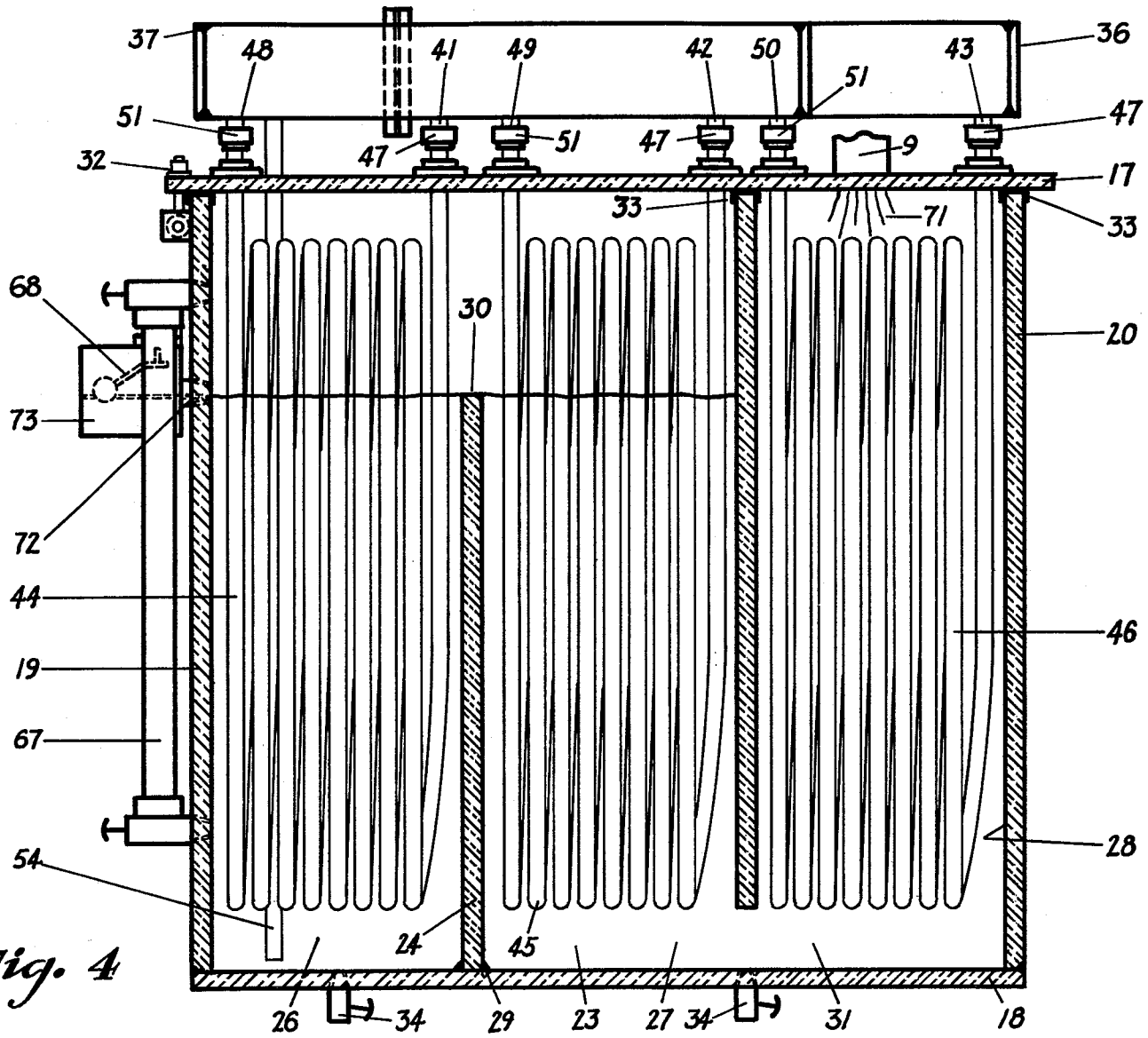
FIG. 4 is a sectional view taken on line 4—4, FIG. 3.

Improved condenser 1 which is one of the main components and features of the improved system is shown particularly in FIGS. 2, 3 and 4. Condenser 1 has a box-like configuration with top and bottom walls 17 and 18, side walls 19 and 20, and end walls 21 and 22 which define an internal condensation chamber 23.

In accordance with the invention, a pair of vertically extending partition walls 24 and 25 are mounted within chamber 23 and divide chamber 23 into vertically extending compartments 26, 27 and 28. Partitions 24 and 25 extend completely across the width of chamber 23 and are secured to end walls 21 and 22. Partition 24 is secured to bottom wall 18 by welds and terminates below top wall 17 forming an upper passage 30 between compartments 26 and 27. Partition 25 abuts top wall 17 and terminates above bottom wall 18 forming a lower passage 31 between compartments 27 and 28.

Top wall 17 preferably is removably mounted on the side and end walls by swing bolts 32 to provide access to chamber 23 for maintenance. Sealing gaskets 33 provide an airtight seal with the side walls, end walls and partition 25 of the condenser (FIG. 4). A pair of blowdown valve 34 are mounted on bottom wall 18 to remove buildup of sediment and other deposits which may accumulate on the bottom of chamber 23.

A pair of elongated rectangular housings 36 and 37 are mounted on opposite ends of top wall 17 forming inlet and outlet flood chambers 38 and 39, respectively. An inlet cooling water line 40 is connected to inlet housing 36 for supplying cooling water from an outside source to inlet flood chamber 38. Hot water outlet line 10 is connected to housing 37 for discharging water from within flood chamber 39 to storage tank 11. Inlet housing 36 is formed with three bottom openings 41, 42, and 43, which are connected to the inlet ends of three separate coiled tubing groups 44, 45, and 46, respectively (FIGS. 3 and 4).

Coil groups 44, 45 and 46 are located within condensing compartments 26, 27 and 28, respectively, with their inlet ends being connected to the respective openings of inlet housing 36 by flanged union connections 47. The outlet ends of coil groups, 44, 45 and 46 communicate with outlet housing 37 through openings 48, 49 and 50, respectively, and are connected to housing 37 by connectors 51. Coil groups 44, 45 and 46 preferably compose a plurality of loops and extend throughout the condensing compartments as shown in FIG. 4.

Steam return line 9 (FIG. 3) communicates with compartment 28 through an opening 52 in top wall 17. A condensate pump 53 is mounted on top wall 17 and includes a delivery pipe 54 which extends downwardly into compartment 26 and terminates just above bottom wall 18. Boiler feed water line 3 also communicates with pump 53 and pipe 54 for delivering the pumped condensate from compartment 26 to feed water tank 2.

Figure 5:
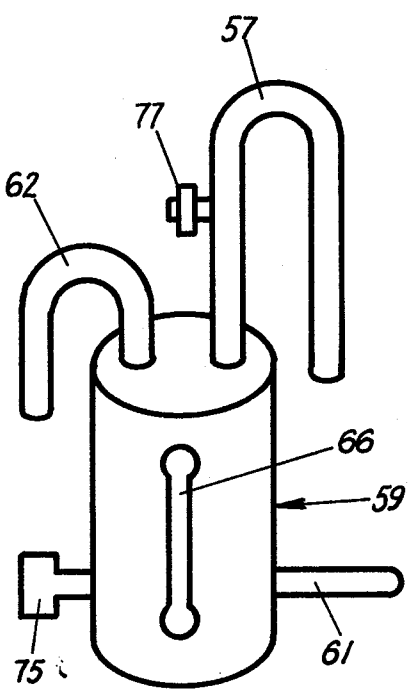
FIG. 5 is a diagrammatic view of the vapor trap of the improved condenser.

In further accordance with the invention, pumping means are provided for removing harmful air from within chamber 23 and for producing a vacuum therein. This pumping means indicated generally at 55, is mounted on top wall 17 (FIG. 3) and includes a vacuum pump 56 which is connected by a pipe 57 through a muffler and filter 58 to a vapor trap 59 (FIG. 5). A liquid transfer pump 60 is connected to trap 59 by a pipe 61. A vapor line 62 extends from inlet flood housing 36 to trap 59 and is connected to a coil 63 which extends throughout the length of inlet flood chamber 38. The inlet end of coil 63 is connected to a line 64 which communicates with the top of compartment 26. Lines 62 and 64 are connected to inlet flood housing 36 by a gasketed flange 65.

Sight glasses 66 and 67 are mounted on vapor trap 59 and condenser wall 19, respectively, to give a visual indication of the liquid level with trap 59 and compartment 26. A mercury float switch 68 communicates with compartment 26 for energizing condensate pump 53 upon the condensate reaching a predetermined level within compartment 26 which is approximately level with the top of partition wall 24. An electrical control and relay box 69 also may be mounted on top wall 17 for housing the necessary controls for the various motors and pumps described above. A pressure relief valve 70 preferably is mounted on top wall 17 and communicates with compartment 28 to prevent damage to condenser 1 and bystanders in the event of a malfunction.

The operation of condenser 1 is described below with particular reference to FIGS. 3 and 4. Used steam indicated at 71, after passing through equipment 7 enters compartment 28 through line 9. A supply of cooling water such as from a municipal water line or well enters inlet line 40 and fills inlet flood chamber 38. This cooling water then flows through tube inlet openings 41–43 and through individual coil tubing groups 44–46 and into outlet flood chamber 39 through outlet tube openings 48–50. This water has increased sufficiently in temperature by extracting heat from the steam with condenser 1. This heated water fills outlet flood chamber 39 and flows through line 10 and into storage tank 11. This heated water then can be used for auxiliary equipment requiring hot water, such as laundry equipment, etc.

Steam 70 contacts coils 46 and condenses into water which drops to the bottom of compartment 28 and flows into compartment 27 together with certain quantities of steam 70 not completely condensed by coils 46. The condensate and any remaining steam in compartment 27 is further cooled and condensed by the cooling water flowing through coil group 45. Thus, the heat extracted from the steam of compartment 28 in the cooling water of coils 46 does not affect the temperature of the cooling water flowing through coils 45.

The condensate flows into compartment 26 upon reaching opening 30 formed by partition 24 and is cooled further by the cooling water flowing through coil group 44. The condensate in compartment 26 upon reaching the top of partition 24 flows through an opening 72 in side wall 19 (FIG. 4) and into float switch chamber 73. Float switch 68 is tripped which energizes condensate transfer pump 53 which transfers the condensate of compartment 26 through delivery pipe 54 and line 3 to boiler feed water tank 2.

The three distinct coil groups 44–46 provide for improved condensation and efficiency of condenser 1. For example, the cooling water in inlet chamber 38 has a temperature of 42° F with compartment 28 initially operating at a temperature of 220° F. The steam and condensate is reduced in temperature in compartment 28 from 220° F. The steam and condensate is reduced in temperature in compartment 28 from 220° to 215° F. The cooling water flowing through coils 46 has risen from 42° to 110° F. The steam and condensate flowing into compartment 27 is approximately 215° F, with the cooling water in coils 45 being again at 42° F which subsequently reduces the steam and condensate to 200° F. The temperature of the condensate and any remaining steam is reduced further by the 42° F cooling water flowing through coils 44 of compartment 26. The cooling water is finally raised to approximately 165° F in outlet chamber 39. This cooling water is carried through the coil groups and into outlet chamber 39 and into hot water tank 11 by its own pressure thereby eliminating additional pumps on related components. This heated water then can be used for other equipment requiring hot water.

In accordance with another feature of the invention, vacuum pump means 55 removes harmful air entrapped within condenser 1. Vacuum pump 56 creates a vacuum in lines 57, 62, 63 and 64 which draws hot gasses, steam and vapor from the top of compartment 26 through line 64, and into line 63. The moisture in the vapor and gases (air) is condensed within line 63 by the cooling water in inlet flood chamber 38. This water and air flow through line 62 and into vapor trap 59. The condensed water drops into trap 59 with the air continuing through line 57 and into the atmosphere through outlet exhaust line 74.

A mercury float switch 75 on vapor trap 59 is energized upon the collected condensate therein reaching a predetermined level. Switch 75 energizes transfer pump 60 which transfers the collected condensate from trap 59 into compartment 27 through pipe 76. A control valve 77 allows outside air to come into trap 59 simultaneously with the operation of transfer pump 60 to destroy the vacuum therein. Check valves 78 in lines 57 and 62 prevent destruction of the vacuum with the condenser upon operation of pump 60.

The improved closed loop steam heating system and condensers therefore described above and shown in the drawings has a number of advantageous features. The system and condenser are applicable to any industry that uses live steam as a source of heat to operational equipment. It is especially adaptable to the laundry industry. Any plant that emits live steam to the atmosphere is wasting energy which is eliminated by the improved system and condenser which converts this energy to a useful commodity.

The temperature of the equipment which is heated by the steam can be raised to the proper temperature by elimination of the heretofore used steam traps by permitting the steam to flow freely through the equipment. Dropoff temperature between the boiler and equipment is minimized by removal of back pressure in the lines by creation of the vacuum within the condenser and in the steam line connecting the equipment and condenser. The condenser removes the air from the condensate and reclaims the air free condensate for use as makeup water for the boiler. Boiler maintenance is reduced and efficiency increased by removal of this harmful oxydizing air thereby lengthening the boiler life.

The use of readily available city water supply for the cooling water is beneficial in that it can be used for a hot water supply after condensing the steam, thereby eliminating waste and reducing costs. Likewise, the individual compartments of the condenser increases condensation efficiency by slowing down the velocity of the steam and condensate moving through the condenser thereby facilitating the condensing process. The vapor trap prevents waste of condensate by returning it to the condenser for subsequent transfer to the boiler feed water tank.

Generally, all of the pumps, pipes, flood chamber, control valves, etc. are mounted on the top cover of the condenser which is removed easily for access into the condenser interior, and for maintenance of the equipment mounted thereon. Various check valves and pressure relief valves are mounted on the condenser and supply lines to prevent damage to the condenser and injury to surrounding equipment and personnel in case of a malfunction.

The temperature of the equipment being heated is controlled easily by a single needle valve which regulates the amount of steam entering the equipment. Thus, more steam is permitted to flow through the equipment to increase the equipment temperature and vice versa. Likewise, the temperature of the cooling water entering the hot water tank from the outlet flood chamber can be regulated easily by varying the amount of and velocity of the water flowing out of the outlet flood chamber by simple valve means.

Thus, the improved system and condenser eliminates existing problems in the art, satisfies needs and provides an efficient means for saving energy to the user. The above description is just one means by which the concepts of the invention may be carried out and the condenser constructed, and the scope of the claims need not be limited to the system and construction specifically illustrated and described.

What is claimed is:

1. In a steam condenser of the type for use in a steam heating system including:

a. an airtight housing having top, bottom, side and end walls defining a condensing chamber;

b. first and second partition means mounted within and extending between the side walls of the condensing chamber, dividing said chamber into first, second and third extending compartments;

c. opening means formed adjacent the top of the first partition means providing a passage between the first and second compartments;

d. opening means formed adjacent the bottom of the second partition means providing a passage between the second and third compartments;

e. individual coil tube means extending into each of the compartments for condensing steam into condensate in said compartments;

f. steam line means communicating with the third compartment for supplying steam to said compartment for condensing therein, with said steam and condensate being adapted to flow into the second and first compartment through the opening means; and g. pump means communicating with the first compartment for maintaining the condenser under a vacuum and for removing condensate from within the first compartment of the condenser, said pump means including a vacuum pump having a vapor delivery pipe communicating with the top portion of the first compartment for removing vapor therefrom; in which the vapor delivery pipe has outlets communicating with the third compartment and with the atmosphere; in which cooling means condenses the vapor within the delivery pipe into water and air; and in which vapor trap means communicates with the vapor delivery pipe and separates the air and water contained therein, with the air being discharged into the atmosphere and the water being discharged into the third compartment through their respective delivery pipe outlets, and in which said vacuum pump forms a vacuum within the condensing chamber during the removal of the vapor therefrom.

2. The condenser defined in claim 1 in which a pair of housings are mounted on the condenser and form inlet and outlet flood chambers, respectively; in which the individual coil tube means each has inlet and outlet ends; in which said inlet and outlet ends of the coild tube means communicate with the inlet and outlet flood chambers respectively; and in which cooling water supply means communicates with the inlet flood chamber for circulating cooling water through the coil tube means and into the outlet flood chamber.

3. The condenser defined in claim 1 in what the pump means includes a condensate pump and a delivery pipe operatively connected with the pump for removing condensate from within the first compartment; and in which the delivery pipe has an inlet opening located adjacent the bottom wall of the condensing chamber.

4. The condenser defined in claim 3 in which float switch means communicates with the first compartment and automatically activates the condensate pump when the condensate reaches a predetermined level within the first compartment for pumping the condensate from within said first compartment.

* * * * *